US007969387B2

(12) United States Patent
Nakamura

(10) Patent No.: US 7,969,387 B2
(45) Date of Patent: Jun. 28, 2011

(54) METHOD FOR DRIVING PLASMA DISPLAY DEVICE

(75) Inventor: Nobuhiko Nakamura, Osaka (JP)

(73) Assignee: Panasonic Corporation, Osaka (JP)

( * ) Notice: Subject to any disclaimer, the term of this patent is extended or adjusted under 35 U.S.C. 154(b) by 107 days.

(21) Appl. No.: 12/446,486

(22) PCT Filed: Apr. 14, 2008

(86) PCT No.: PCT/JP2008/000970

§ 371 (c)(1),
(2), (4) Date: Apr. 21, 2009

(87) PCT Pub. No.: WO2008/132804

PCT Pub. Date: Nov. 6, 2008

(65) Prior Publication Data

US 2010/0315404 A1 Dec. 16, 2010

(30) Foreign Application Priority Data

Apr. 25, 2007 (JP) ..... 2007-115180

(51) Int. Cl.
*G09G 3/28* (2006.01)

(52) U.S. Cl. ..... 345/60; 345/212

(58) Field of Classification Search ..... 345/60, 345/212, 63, 66, 76, 77, 82, 87, 94, 95
See application file for complete search history.

(56) References Cited

U.S. PATENT DOCUMENTS

2003/0197696 A1* 10/2003 Onozawa et al. ..... 345/212
2005/0073483 A1* 4/2005 Lee et al. ..... 345/63
2005/0116886 A1* 6/2005 Jeong et al. ..... 345/60
2005/0116894 A1* 6/2005 Lee et al. ..... 345/60
2005/0259044 A1* 11/2005 Choi et al. ..... 345/63
2006/0290597 A1* 12/2006 Moon ..... 345/60
2006/0290599 A1* 12/2006 Yoo ..... 345/60
2008/0062096 A1* 3/2008 Yamashita et al. ..... 345/82
2008/0198102 A1* 8/2008 Yamashita et al. ..... 345/76

FOREIGN PATENT DOCUMENTS

JP 2001-255848 A 9/2001
JP 2002-351398 A 12/2002
JP 2003-043989 A 2/2003
JP 2005-037604 A 2/2005
JP 2005-250318 A 9/2005
JP 2005-316480 A 11/2005

OTHER PUBLICATIONS

International Search Report for PCT/JP2008/000970 dated Jul. 15, 2008.

* cited by examiner

*Primary Examiner* — Ricardo L Osorio
(74) *Attorney, Agent, or Firm* — RatnerPrestia

(57) ABSTRACT

In the method for driving a plasma display device, the plasma display panel are applied with voltage through the following process. In the first address period where an address discharge is generated on the scan electrodes that belong to the first scan electrode group, the third switching element is turned OFF so as to give a different value of reference voltage between the first and the second scan electrode driving sections. In the second address period where an address discharge is generated on the scan electrodes that belong to the second scan electrode group, the third switching element is turned ON so as to give a same value of reference voltage between the first and the second scan electrode driving sections. In the sustain period where sustain pulses are applied to a plurality of scan electrodes to generate a sustain discharge in the discharge cells, the third switching element is turned ON.

2 Claims, 6 Drawing Sheets

METHOD FOR DRIVING PLASMA DISPLAY DEVICE

THIS APPLICATION IS A U.S. NATIONAL PHASE APPLICATION OF PCT INTERNATIONAL APPLICATION PCT/JP2008/000970.

TECHNICAL FIELD

The present invention relates to a method for driving a plasma display device employing a plasma display panel.

BACKGROUND ART

An AC-type surface discharge plasma display panel has become dominant in plasma display panels (hereinafter referred to as a panel). A panel contains a front plate and a rear plate oppositely disposed with each other and a plurality of discharge cells therebetween.

The front plate has a glass-made front substrate on which display electrode pairs, each of which is formed of a scan electrode and a sustain electrode, are arranged in parallel with each other. The rear plate has a glass-made rear substrate on which data electrodes are disposed in a parallel arrangement. The front plate and the rear plate are sealed with each other in a manner that the display electrode pairs are placed orthogonal to the data electrodes. A discharge space, which is formed between the front plate and the rear plate, is filled with discharge gas. Discharge cells are formed at intersections of the display electrode pairs and the data electrodes.

In the typical panel operation, one field period is divided into a plurality of subfields, which is known as a subfield method. According to the subfield method, gray scale display on the panel is attained by combination of the subfields to be lit.

Each subfield has an initializing period, an address period and a sustain period. In the initializing period, an initializing discharge occurs in the discharge cells. The initializing discharge generates wall charge on each electrode as a preparation for an address operation in the address period that follows the initializing period. In the address period, scan pulses are sequentially applied to the scan electrodes and address pulses are selectively applied to the data electrodes, so that an address discharge occurs selectively in the discharge cells. In the sustain period, sustain pulses are alternately applied between the scan electrodes and the sustain electrodes of the display electrode pairs. The application of the sustain pulses generates a sustain discharge in a discharge cell in which an address discharge has been generated in the previous address discharge, allowing the cell to light on. Through the process above, image is shown on the panel.

In the panel driving on the subfield method, applying address pulses to the data electrodes, with no application of scan pulses to the scan electrodes, often causes decrease in wall charges required for an address operation, so that a successful address discharge cannot be expected. To address the problem above, for example, patent document 1 introduces an improved driving method. According to the method, the scan electrodes are divided into four scan electrode groups, and at the same time, the address period is divided into four sub-periods. Scan pulses applied to the scan electrodes of a group at a predetermined sub-period; in the meantime, the rest three groups that have no scan pulse are applied with voltage higher than the scan pulses that are applied to the group.

However, the aforementioned method above has some problems below:

- an excessive difference in voltage arises between adjacent scan electrodes, causing a spark between electrode terminals of the panel or between wiring patterns of a printed circuit board;
- a short-circuit can occur at a scan electrode lead-out part of the panel due to migration;
- a scan electrode group individually receives driving voltage from a scan electrode driving circuit that is dedicated to the group. This causes a slight difference between driving-voltage waveforms that are applied to each scan electrode group. Because of the difference, an unwanted line appears in the image-display area corresponding to the boundary between scan electrode groups, deteriorating the quality of the image;
- each of the scan electrode groups is driven by a separately disposed scan electrode driving circuit corresponding to each group. The entire circuit has a larger and more complicated structure.

Patent document 1: Japanese Unexamined Patent Application Publication No. 2003-43989

SUMMARY OF THE INVENTION

The present invention provides a method for driving a plasma display device capable of suppressing decrease in wall charges and generating a stable address discharge with no worry about a spark and a short-circuit. At the same time, the method offers a simplified circuit structure with partially shared use of the scan electrode driving circuits each of which is dedicated to a divided group of the scan electrodes.

According to the method for driving a plasma display device using a plasma display panel having a plurality of scan electrodes and a plurality of discharge cells, the scan electrodes are divided into a first scan electrode group and a second scan electrode group. The plasma display device has a first scan electrode driving section that drives the scan electrodes of the first scan electrode group, a second scan electrode driving section that drives the scan electrodes of the second scan electrode group, a sustain pulse generating section for generating a sustain pulse to be applied to the plurality of scan electrodes, a first switching element that adds the sustain pulse onto reference voltage of the first scan electrode driving section, a second switching element that adds the sustain pulse onto reference voltage of the second scan electrode driving section, and a third switching element that connects between the reference voltage of the first scan electrode driving section and the reference voltage of the second scan electrode driving section. One field period is formed of a plurality of subfields, each of the subfields contains the following periods:

an initializing period for generating a initializing discharge in the discharge cells;

a first address period for generating an address discharge on the scan electrodes of the first scan electrode group;

a second address period for generating an address discharge on the scan electrodes of the second scan electrode group; and a sustain period for applying sustain pulses to the scan electrodes and generating a sustain discharge in the discharge cells.

The method comprises:

applying a different voltage between the reference voltage of the first scan electrode driving section and the reference voltage of the second scan electrode driving section by turning OFF the third switching element in the first address period;

applying a same voltage between the reference voltage of the first scan electrode driving section and the reference voltage of the second scan electrode driving section by turning ON the third switching element in the second address period; and in the sustain period, adding the sustain pulse onto the reference voltage of the first scan electrode driving section and the reference voltage of the second scan electrode driving section by turning ON the first switching element and the second switching element; and turning ON the third switching element.

REFERENCE MARKS IN THE DRAWINGS

Figure 1:
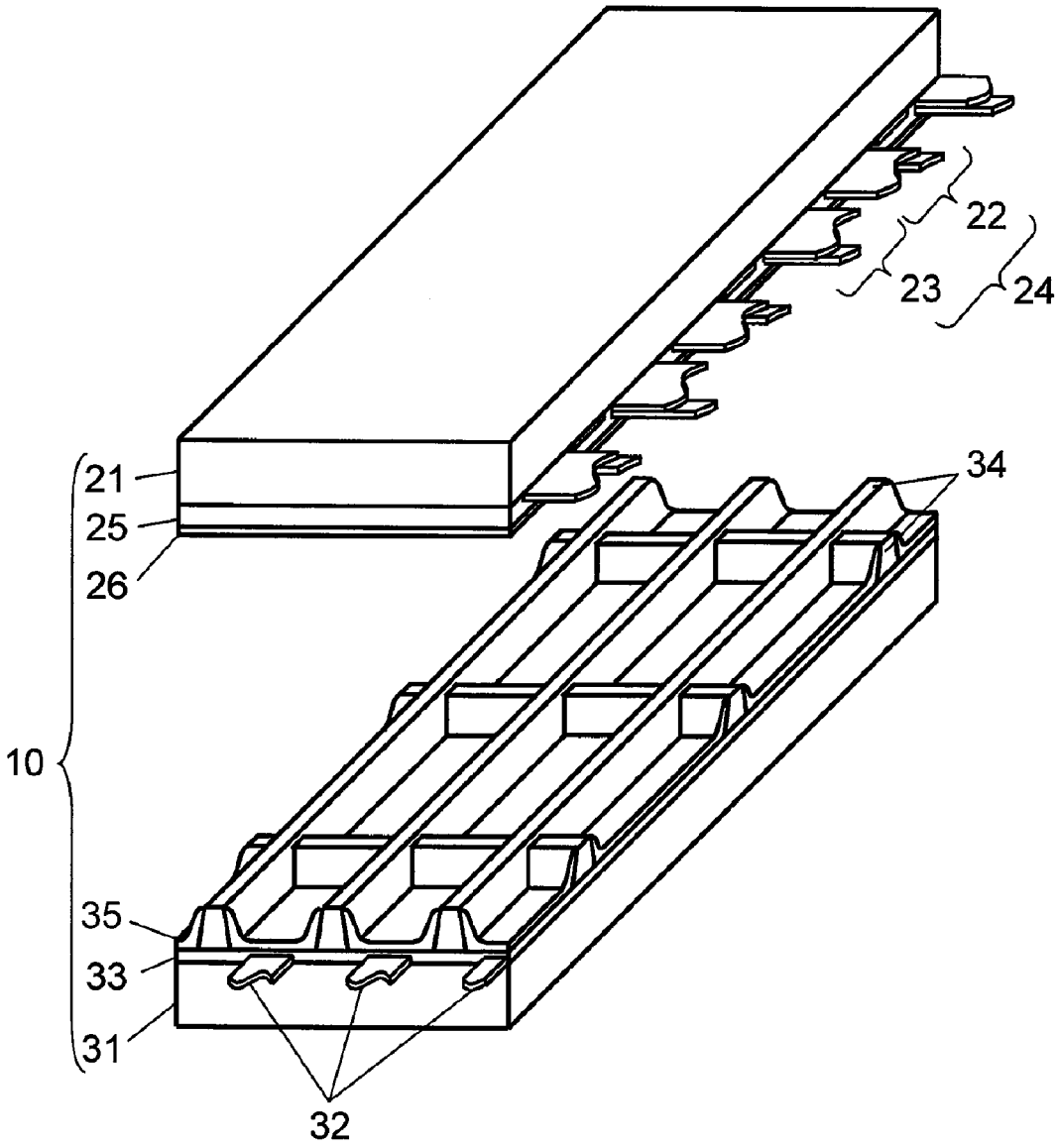
FIG. 1 is an exploded perspective view showing the structure of the panel in accordance with an exemplary embodiment of the present invention.

10 panel
22 scan electrode
23 sustain electrode
24 display electrode pair
32 data electrode
41 image signal processing circuit
42 data electrode driving circuit
43 scan electrode driving circuit
44 sustain electrode driving circuit
45 timing signal generating circuit
51 sustain pulse generator
53 rising ramp voltage generator
60 first scan electrode driver (odd scan electrode driver)
61 falling ramp voltage generator
62 scan pulse voltage applying section
63 voltage comparator
71 signal delaying section
80 second scan electrode driver (even scan electrode driver)
81 signal transmitting section
90 composite switch section
100 plasma display device

DETAILED DESCRIPTION OF THE PREFERRED EMBODIMENTS

The plasma display device and the method for driving of an exemplary embodiment of the present invention is described hereinafter with reference to the accompanying drawings.

Exemplary Embodiment

FIG. 1 is an exploded perspective view showing the structure of panel 10 in accordance with an exemplary embodiment of the present invention. On glass-made front substrate 21, display electrode pairs 24 formed of scan electrodes 22 and sustain electrodes 23 are arranged, and over which, dielectric layer 25 is formed to cover scan electrodes 22 and sustain electrodes 23. Protective layer 26 is formed over dielectric layer 25. On rear substrate 31, data electrodes 32 are disposed, and over which, dielectric layer 33 is formed to cover data electrodes 32. On dielectric layer 33, barrier ribs 34 are formed in a grid arrangement. Phosphor layer 35, which emits light in red, green and blue, is formed on dielectric layer 33 and on the side surfaces of barrier ribs 34.

Front substrate 21 and rear substrate 31 are oppositely disposed in a manner that display electrode pairs 24 are placed orthogonal to data electrodes 32 in a narrow discharge space between the two substrates. The two substrates are sealed at the peripheries with a sealing material such as glass frit. The discharge space is filled with discharge gas, for example, a mixed gas of neon and xenon. The discharge space is divided into sections by barrier ribs 34. Discharge cells are formed at intersections of display electrode pairs 24 and data electrodes 32. Generating a discharge allows a discharge cell to emit light, so that an image appears on the panel.

Panel 10 does not necessarily have the structure above; the barrier ribs may be formed into stripes.

Figure 2:
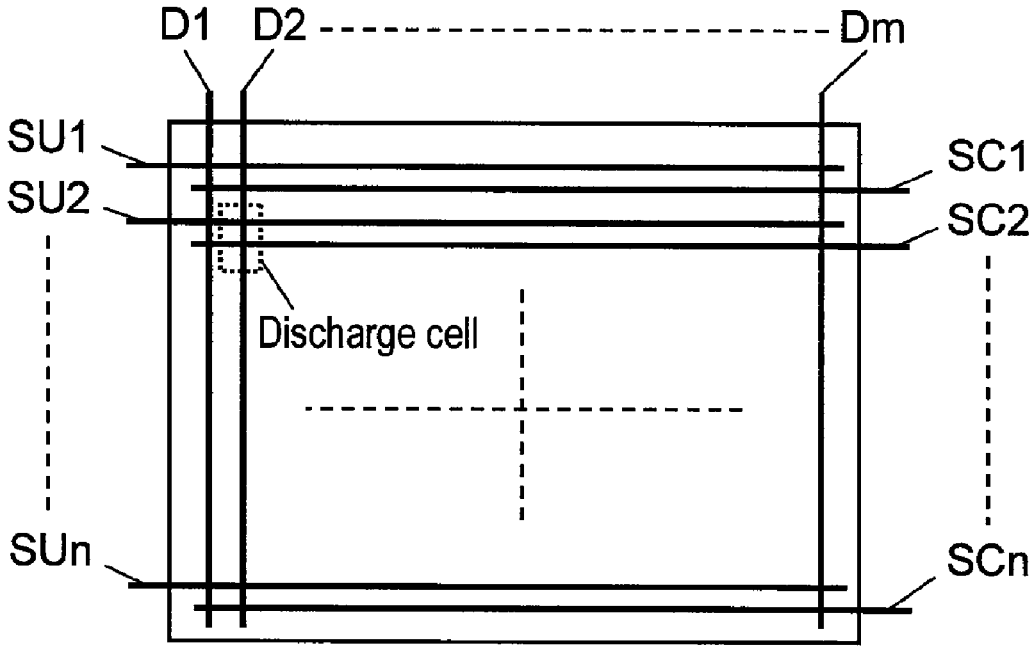
FIG. 2 shows an electrode layout of the panel of the embodiment.

FIG. 2 shows an electrode layout of panel 10 in accordance with the embodiment. In the horizontal direction, panel 10 has n (n takes an even number) long scan electrodes SC1-SCn (corresponding to scan electrodes 22 in FIG. 1) and n long sustain electrodes SU1-SUn (corresponding to sustain electrodes 23 in FIG. 1). In the vertical direction, panel 10 has m long data electrodes D1-Dm (corresponding to data electrodes 32 in FIG. 1). A discharge cell is formed at an intersection of a pair of scan electrode SCi and sustain electrode SUi (i takes 1 to n) and data electrode Dj (j takes 1 to m). That is, panel 10 contains m×n discharge cells in the discharge space.

The description of the exemplary embodiment will be given on the understanding that n takes an even number and scan electrodes SC1, SC3, . . . , SCn-1 located in odd rows belong to the first scan electrode group, whereas scan electrodes SC2, SC4, . . . , SCn located in even rows belong to the second scan electrode group.

Figure 3:
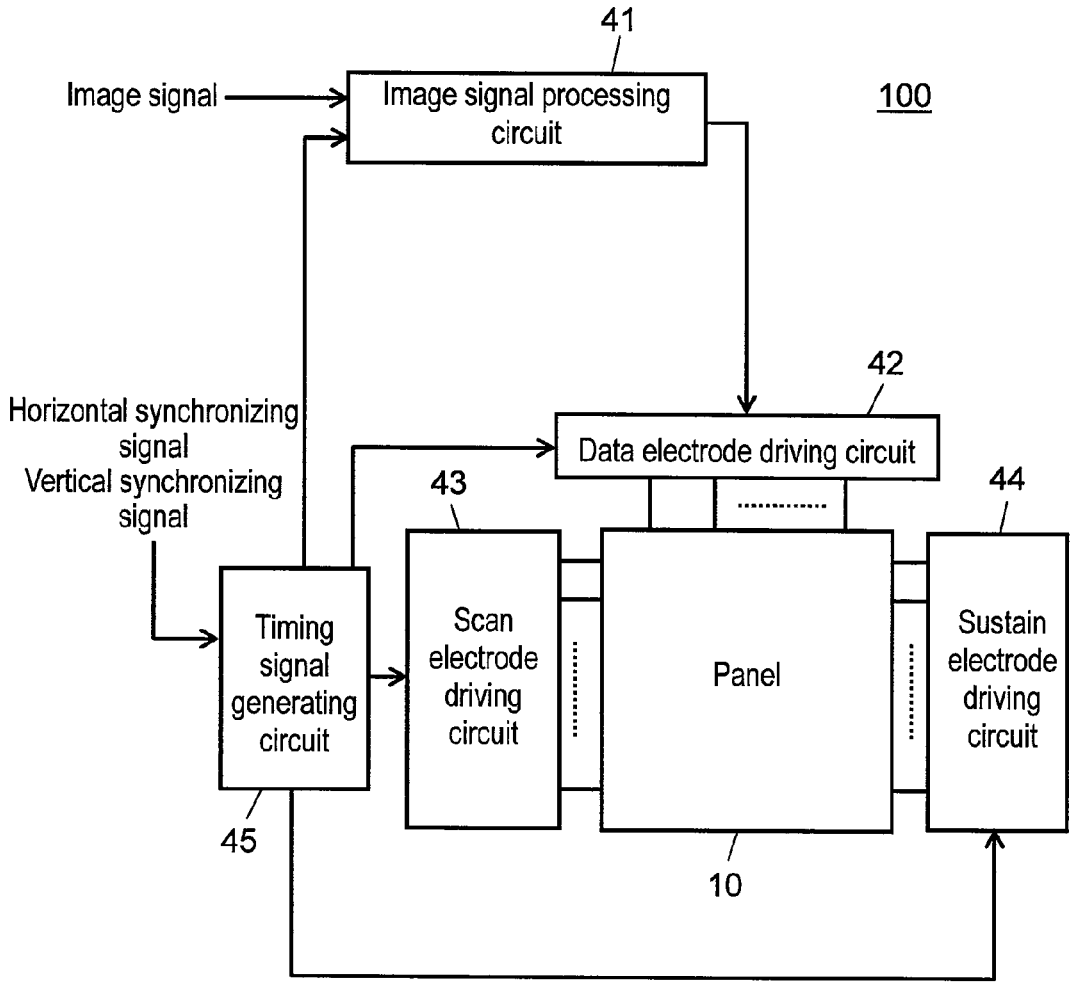
FIG. 3 is a circuit block diagram of a plasma display device of the embodiment.

FIG. 3 is a circuit block diagram of plasma display device 100 of the embodiment. Plasma display device 100 has panel 10, image signal processing circuit 41, data electrode driving circuit 42, scan electrode driving circuit 43, sustain electrode driving circuit 44, timing signal generating circuit 45 and power supply section (not shown) for supplying power to each circuit block.

Receiving an image signal, image signal processing circuit 41 converts it into image data for light-emitting or non-light-emitting on a subfield basis. Data electrode driving circuit 42 converts the image data of each subfield into signals suitable for data electrodes D1-Dm to drive them.

Timing signal generating circuit 45 generates timing signals that control each circuit block according to a horizontal synchronizing signal and a vertical synchronizing signal, and the timing signals are fed to each circuit block. According to the timing signals, scan electrode driving circuit 43 drives scan electrodes SC1-SCn; similarly, sustain electrode driving circuit 44 drives sustain electrodes SU1-SUn.

Next will be described waveforms of driving voltage for driving panel 10 and the operations of them. Plasma display device 100 employs a subfield method to provide gradation. In the subfield method, one field period is divided into a plurality of subfields, and light-emitting control of the discharge cells is carried out on a subfield basis. Each subfield has an initializing period, an address period and a sustain period. The initializing period is responsible for generating an initializing discharge to form wall charges on each electrode as a preparation for an address discharge that follows the initializing discharge. In the address period, an address discharge is selectively generated in a discharge cell to be lit and wall charges are formed on each electrode. In the sustain period, a sustain discharge is generated in the discharge cell where an address discharge has occurred.

According to the structure of the embodiment, the address period is divided into two periods: a first address period where scan pulses are sequentially applied to the scan electrodes that belong to the first scan electrode group, and a second address period where scan pulses are sequentially applied to the scan electrodes that belong to the second scan electrode group. The first scan electrode group has scan electrode SC1, SC3, . . . , SCn-1 located in odd rows. The second scan electrode group has scan electrode SC2, SC4, . . . , SCn located in even rows. Hereinafter, for the sake of convenience, the first address period will be referred to as an odd period and the second address period will be referred to as an even period.

Figure 4:
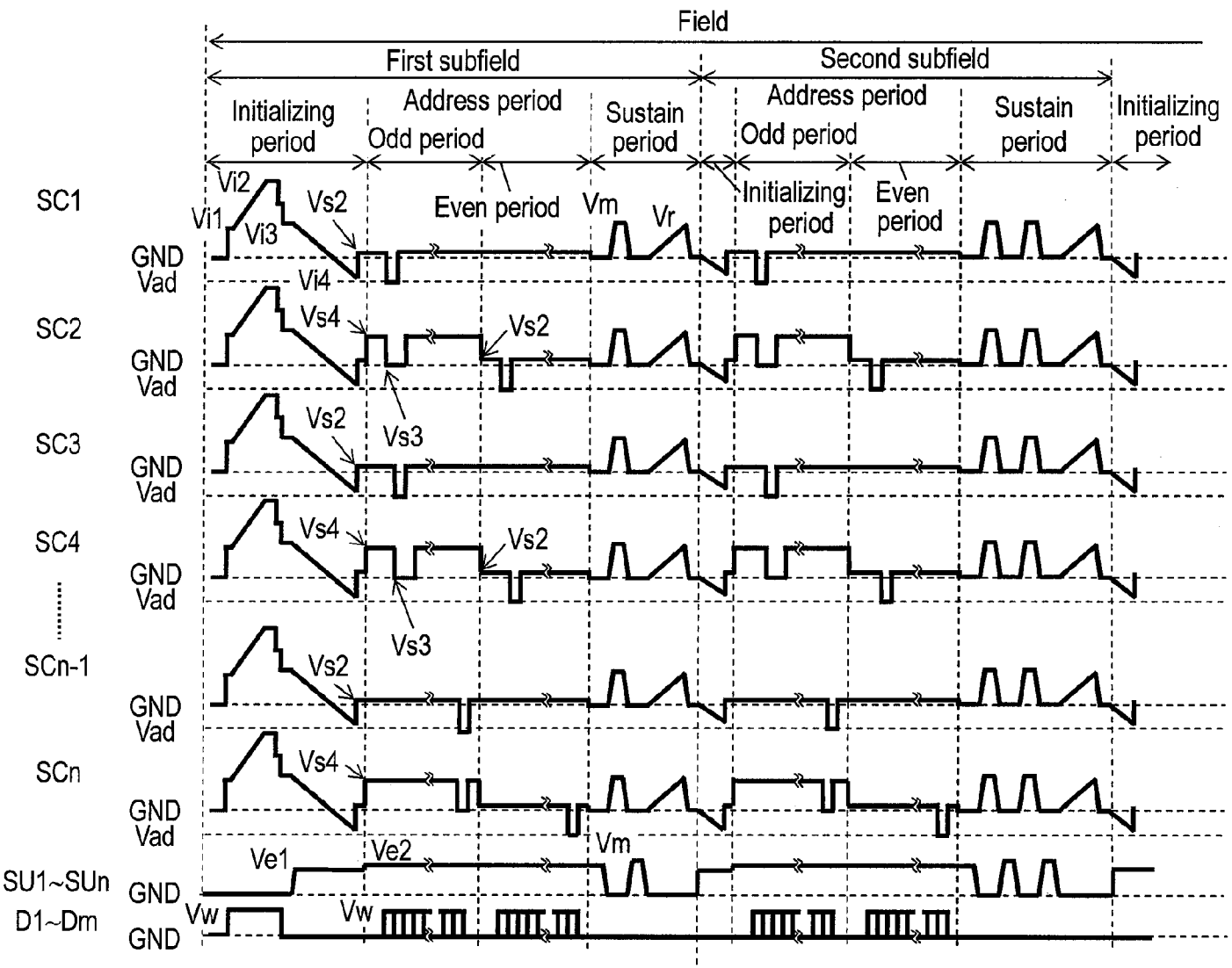
FIG. 4 shows waveforms of driving voltage to be applied to each electrode of the panel of the embodiment.

Next will be described waveforms of driving voltage for driving panel 10 and the operations of them. FIG. 4 shows waveforms of driving voltage to be applied to each electrode on panel 10. Although one field period is formed of, for example, ten subfields, FIG. 4 shows waveforms of driving voltage in only two subfields.

In the first half of the initializing period of the first subfield, address pulse voltage Vw is applied to data electrodes D1-Dm, and voltage of zero (0V) is applied to sustain electrodes SU1-SUn. Voltage of zero (0V) is represented by GND in FIG. 4. Scan electrodes SC1-SCn are applied with voltage with gradually increasing ramp waveform, starting from voltage Vi1 (that is lower than the breakdown voltage for sustain electrodes SU1-SUn) toward voltage Vi2 (that exceeds the breakdown voltage). During the application of the rising ramp voltage, a weak initializing discharge occurs between scan electrodes SC1-SCn and sustain electrodes SU1-SUn, and between scan electrodes SC1-SCn and data electrodes D1-Dm. Through the initializing discharge, negative wall voltage is built up on scan electrodes SC1-SCn, on the other hand, positive wall voltage is built up on data electrodes D1-Dm and sustain electrodes SU1-SUn. The wall voltage on each electrode represents a voltage generated by wall charges built up on the dielectric layer, the protective layer and the phosphor layer on the electrodes. In the latter half of the initializing period, voltage of zero (0V) is applied to data electrodes D1-Dm and positive voltage Ve1 is applied to sustain electrodes SU1-SUn. Scan electrodes SC1-SCn are applied with voltage with gradually decreasing ramp waveform, starting from voltage Vi3 (that is lower than the breakdown voltage for sustain electrodes SU1-SUn) toward voltage Vi4 (that exceeds the breakdown voltage). During the application of the falling ramp voltage, a weak initializing discharge occurs between scan electrodes SC1-SCn and sustain electrodes SU1-Sun, and between scan electrodes SC1-SCn and data electrodes D1-Dm. Through the discharge, the negative wall voltage on scan electrodes SC1-SCn and the positive wall voltage on sustain electrodes SU1-SUn are weakened. On the other hand, the positive wall voltage on data electrodes D1-Dm is adjusted to a value suitable for the address operation.

The first half of the initializing period may be omitted in some subfields of all the subfields constituting the one field period. In that case, the initializing operation is selectively carried out in a discharge cell where a sustain discharge has been generated in the previous subfield. FIG. 4 shows an example of waveforms of driving voltage for carrying out initializing operation. In the example, the initializing period of the first subfield has the first half and the latter half, whereas the initializing period of the second and later subfields has the latter half only.

In the odd period of the address period, voltage Ve2 is applied to sustain electrodes SU1-SUn. Second voltage Vs2 is applied to scan electrodes SC1, SC3, . . . , SCn-1 located in odd rows, whereas fourth voltage Vs4 is applied to scan electrodes SC2, SC4, . . . , SCn located in even rows. Fourth voltage Vs4 is greater than second voltage Vs2.

Next, negative scan pulse voltage Vad is applied to scan electrode SC1 located in the first row, and positive address pulse voltage Vw is applied to data electrode Dk (k takes 1 to m), which corresponds to the discharge cell to be lit in the first row, in data electrodes D1-Dm. In the embodiment, third voltage Vs3, which is lower than fourth voltage Vs4, is applied to second scan electrode SC2 located next to scan electrode SC1. This prevents an excessive difference in voltage between neighboring scan electrodes SC1 and SC2.

At this time, difference in voltage at the intersection of data electrode Dk and scan electrode SC1 is calculated by adding the difference in wall voltage between data electrode Dk and scan electrode SC1 to the difference in voltage applied from outside (i.e., Vw−Vad). The calculated value exceeds the breakdown voltage, thereby generating an address discharge between data electrode Dk and scan electrode SC1, and between sustain electrode SU1 and scan electrode SC1. In this way, an address discharge occurs in a discharge cell to be lit. Through the address discharge, positive wall voltage is built up on scan electrode SC1 and negative wall voltage is built up on sustain electrode SU1 and data electrode Dk. In an address operation, as described above, an address discharge is generated so as to build up wall voltage on each electrode in the discharge cell to be lit in the first row. On the other hand, the voltage at the intersection of scan electrode SC1 and data electrodes D1-Dm with no application of address pulse voltage Vw is lower than the breakdown voltage and therefore no address discharge.

Next, scan pulse voltage Vad is applied to scan electrode SC3 located in the third row, and positive address pulse voltage Vw is applied to data electrode Dk, which corresponds to the discharge cell to be lit in the third row, in data electrodes D1-Dm. At the same time, third voltage Vs3 is applied to scan electrode SC2 in the second row and scan electrode SC4 in the fourth row that are adjacent to scan electrode SC3. The application of voltage above causes an address discharge between data electrode Dk and scan electrode SC3, and between sustain electrode SU3 and scan electrode SC3, by which wall voltage is built up on each electrode. The address operation is thus carried out on the discharge cells to be lit in the third row.

The address operation is carried out in a same manner for the rest of the scan electrodes located in odd rows: SC5, SC7, . . . , SCn-1. At this time, i.e., when scan electrode SCp+1 (where, p takes an even number and 1<p<undergoes the address operation, third voltage Vs3 is applied to scan electrode SCp and scan electrode SCp+2 that are adjacent to scan electrode SCp+1.

In the even period that follows the odd period of the address period, scan electrodes SC1, SC3, . . . , SCn-1 still has the application of second voltage Vs2. With the condition maintained, second voltage Vs2 is also applied to scan electrodes SC2, SC4, . . . , SCn in the even rows.

Next, negative scan pulse voltage Vad is applied to scan electrode SC2 in the second row, and positive address pulse voltage Vw is applied to data electrode Dk, which corresponds to the discharge cell to be lit in the second row, in data electrodes D1-Dm. Through the application of voltage above, difference in voltage at the intersection of data electrode Dk and scan electrode SC2 exceeds the breakdown voltage, generating an address discharge in the discharge cell to be lit, by which wall voltage is built up on each electrode. The address operation is thus carried out on the discharge cells to be lit in the second row.

Similarly, scan pulse voltage Vad is applied to scan electrode SC4 in the fourth row, and positive address pulse voltage Vw is applied to data electrode Dk, which corresponds to the discharge cell to be lit in the fourth row. The application of voltage above causes an address discharge in the discharge cell.

The address operation is carried out in a same manner for the rest of the scan electrodes located in even rows: SC6, SC8, . . . , SCn.

The panel operation with the driving voltage above never causes voltage difference that exceeds voltage (Vs3−Vad) between adjacent scan electrodes, and therefore no worry about insulation breakdown and migration. Besides, the address operation on the scan electrodes in the odd rows has already completed in the odd period, which prevents the deterioration of image quality, even if wall charges on the scan electrode located in the odd rows decrease in the even period.

In the sustain period that follows the address period, positive sustain pulse voltage Vm is applied to scan electrodes SC1-SCn, and at the same time, voltage of zero (0V) is applied to sustain electrodes SU1-SUn. At this time, in the discharge cell where an address discharge occurred in the previous period, difference in voltage between scan electrode SCi and sustain electrode SUi is calculated by adding sustain pulse voltage Vm to the difference between the wall voltage on scan electrode SCi and the wall voltage on sustain electrode SUi. The calculated value exceeds the breakdown voltage, thereby generating a sustain discharge between scan electrode SCi and sustain electrode SUi. The sustain discharge produces ultraviolet light, allowing phosphor layer 35 to emit light. Negative wall voltage is built up on scan electrode SCi and positive wall voltage is built up on sustain electrode SUi and data electrode Dk. A discharge cell without an address discharge in the previous address period has no sustain discharge and therefore maintains the wall voltage the same as that at the end of the initializing period.

Next, voltage of zero (0V) is applied to scan electrodes SC1-SCn and sustain pulse voltage Vm is applied to sustain electrodes SU1-SUn. In the discharge cell where a sustain discharge occurred, difference in voltage between sustain electrode SUi and scan electrode SCi exceeds the breakdown voltage, thereby generating a sustain discharge again between sustain electrode SUi and scan electrode SCi. Through the discharge, negative wall voltage is built up on sustain electrode SUi and positive wall voltage is built up on scan electrode SCi. In this way, scan electrodes SC1-SCn and sustain electrodes SU1-SUn alternately undergo sustain pulses (where the number of the pulses to be applied are determined by multiplying a luminance weight by a luminance factor), providing difference in voltage between the scan electrodes and the sustain electrodes of display electrode pairs 24. This allows the sustain discharge to continuously occur in a discharge cell where an address discharge has occurred in the address period.

At the end of the sustain period, scan electrodes SC1-SCn are applied with voltage with a ramp waveform gradually increasing toward voltage Vr. The application of voltage weakens wall voltage on scan electrode SCi and sustain electrode SUi, with the positive wall voltage on data electrode Dk maintained. The sustain operation in the sustain period thus completes.

Next will be described the detail structure of scan electrode driving circuit 43. In the embodiment, the description will be given with the assumption that the difference between second voltage Vs2 and scan pulse voltage Vad equals to the difference between fourth voltage Vs4 and third voltage Vs3. Hereinafter, the difference is referred to as voltage Vscn, that is, according to the assumption above, (Vs2−Vad)=(Vs4−Vs3)=Vscn.

Figure 5:
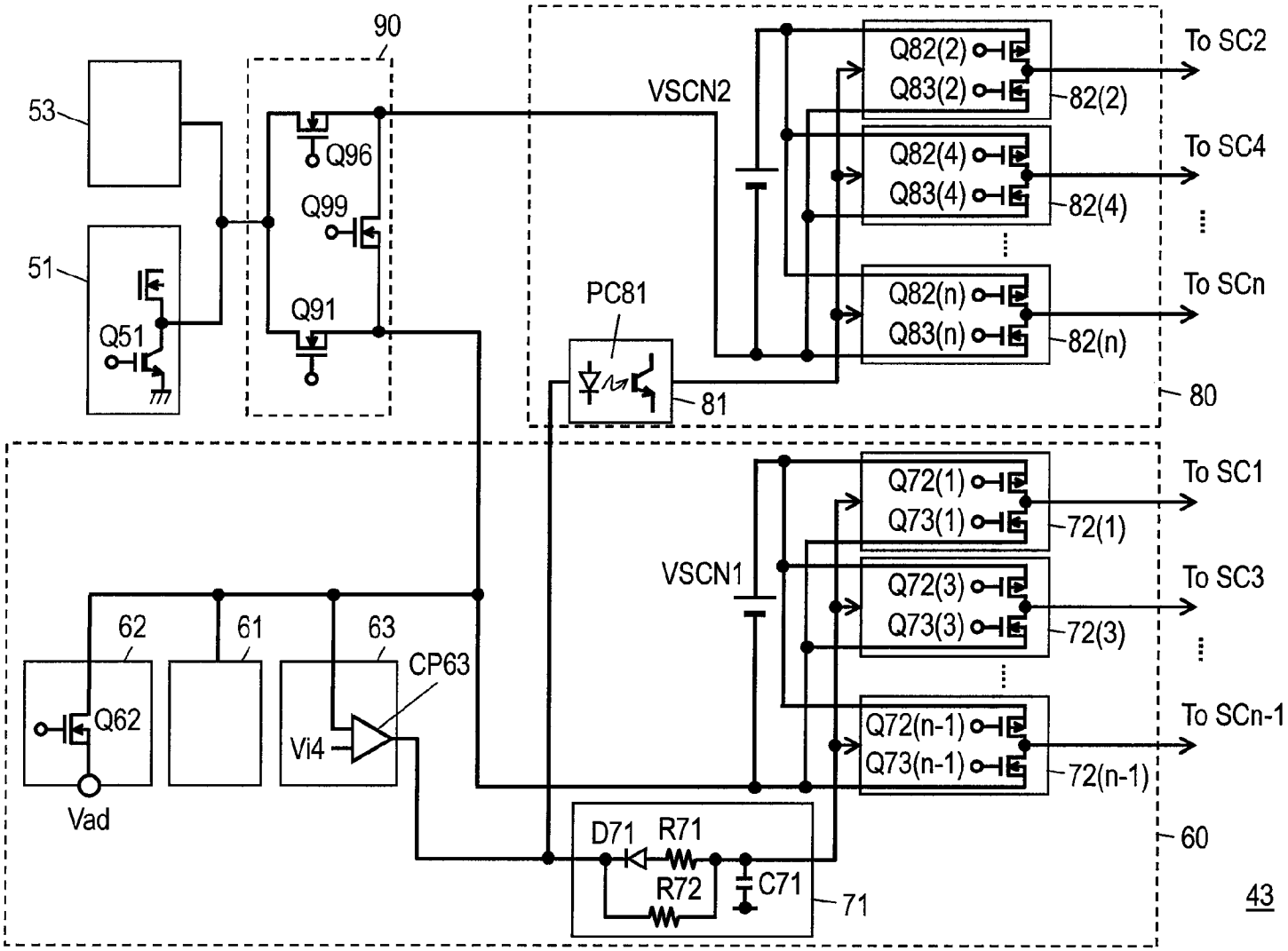
FIG. 5 is a circuit diagram of a scan electrode driving circuit of the embodiment.

FIG. 5 is a circuit diagram of scan electrode driving circuit 43 of the embodiment. Scan electrode driving circuit 43 has sustain pulse generator 51, rising ramp voltage generator 53, first scan electrode driver (first scan electrode driving section) 60, second scan electrode driver (second scan electrode driving section) 80 and composite switch section 90. According to the structure of the embodiment, first scan electrode driver 60 drives the scan electrodes located in odd rows, and second scan electrode driver 80 drives the scan electrodes located in even rows. Therefore, hereinafter, first scan electrode driver 60 is referred to as odd scan electrode driver 60 and second scan electrode driver 60 is referred to as even scan electrode driver 80.

Sustain pulse generator (sustain pulse generating section) 51 has a switching element for outputting sustain pulse voltage Vm, a switching element for outputting voltage of zero (0V) and a circuit for power recovery. With the structure above, sustain pulse generator 51 generates sustain pulses to be applied to scan electrodes SC1-SCn in the sustain period. FIG. 5 shows switching element Q51 only, which outputs voltage of zero (0V). Rising ramp voltage generator 53 generates a gradually rising ramp voltage to be applied to scan electrodes SC1-SCn in the first half of the initializing period and in the end of the sustain period.

Odd scan electrode driver 60 has falling ramp voltage generator 61, scan pulse voltage applying section 62, voltage comparator 63, signal delaying section 71, first floating power supply VSCN1 (hereinafter simply referred to as power supply VSCN1), and first output sections (hereinafter simply referred to as output sections) 72 (1), 72 (3), . . . , 72 (n−1).

Falling ramp voltage generator 61 gradually decreases reference voltage of odd scan electrode driver 60 in the latter half of the initializing period. Scan pulse voltage applying section 62 has switching element Q62 that connects the reference voltage of odd scan electrode driver 60 to scan pulse voltage Vad in the address period.

Voltage comparator 63, which has comparator CP63, compares the reference voltage of odd scan electrode driver 60 to voltage Vi4 in the latter half of an initializing period.

Signal delaying section 71, which has resistor R71, resistor R72, diode D71, and capacitor C71, retards the output of voltage comparator 63 by a time the same as the delay time of signal transmitting section 81 and transmits the delayed output to odd scan electrode driver 60.

Power supply VSCN1 generates voltage Vscn. The lower voltage side of power supply VSCN1 is connected to the reference voltage of odd scan electrode driver 60. Output sections 72 (1), 72 (3), . . . , 72 (n−1) apply voltage of the lower voltage side or the higher voltage side of power supply VSCN1 to scan electrodes SC1, SC3, . . . , SCn-1 located in odd rows, respectively. Output sections 72 (1), 72 (3), . . . , 72 (n−1) have switching elements Q72 (1), Q72 (3), . . . , Q72 (n−1) for outputting voltage of the higher voltage side of power supply VSCN1 and switching elements Q73 (1), Q73 (3), . . . , Q73 (n−1) for outputting voltage of the lower voltage side of power supply VSCN1.

Even scan electrode driver 80 has signal transmitting section 81, second floating power supply VSCN2 (hereinafter referred to simply as power supply VSCN2), second output sections (hereinafter, output sections) 82 (2), 82 (4), . . . , 82 (n).

Signal transmitting section 81, which has photocoupler PC81, transmits the output of voltage comparator 63 to even scan electrode driver 80.

Power supply VSCN2 generates voltage Vscn. The lower voltage side of power supply VSCN2 is connected to the reference voltage of even scan electrode driver 80. Output sections 82 (2), 82 (4), . . . , 82 (n) apply voltage of the lower voltage side or the higher voltage side of power supply VSCN2 to scan electrodes SC2, SC4, . . . , SCn located in even rows, respectively. Output sections 82 (2), 82 (4), . . . , 82 (n) have switching elements Q82 (2), Q82 (4), . . . , Q82 (n) for outputting voltage of the higher voltage side of power supply VSCN2 and switching elements Q83 (2), Q83 (4), . . . , Q83 (n) for outputting voltage of the lower voltage side of power supply VSCN2.

Composite switch section 90 has first switching element Q91, second switching element Q96 and third switching element Q99. First switching element Q91 adds the output of sustain pulse generator 51 or rising ramp voltage generator 53 on the reference voltage of odd scan electrode driver 60. Second switching element Q96 adds the output of sustain pulse generator 51 or rising ramp voltage generator 53 on the reference voltage of even scan electrode driver 80. Third switching element Q99 connects the reference voltage of odd scan electrode driver 60 to the reference voltage of even scan electrode driver 80. Hereinafter, first switching element Q91, second switching element Q96, third switching element Q99 will be referred to simply as switching element Q91, switching element Q96, switching element Q99, respectively.

Although power supplies VSCN1, VSCN2 may be formed of, for example, a DC-DC converter, they can be simply structured with the use of a bootstrap circuit having a diode and a capacitor. According to the embodiment, both of power supplies VSCN1 and VSCN2 output voltage Vscn, and therefore second voltage Vs2 equals to (Vad+Vscn) and fourth voltage Vs4 equals to (Vs3+Vscn). Scan pulse voltage Vad is set to −140 (V), voltage Vscn is set to 150 (V), and third voltage Vs3 is set to 0(V). The values above are cited merely by way of example. They should be determined to an optimum value according to characteristics of the panel.

As is shown in FIG. 5, scan pulse voltage applying section 62, falling ramp voltage generator 61 and voltage comparator 63 are disposed on the side of odd scan electrode driver 60 so that their output voltage are added on the reference voltage of odd scan electrode driver 60. In contrast, there is no similar circuit on the side of even scan electrode driver 80. According to the structure of the embodiment, the reference voltage of even scan electrode driver 80 is gradually decreased in the latter half of an initializing period, and scan pulse voltage Vad is added on the reference voltage of even scan electrode driver 80 in an address period by operation of switching element Q99 that connects reference voltage between odd scan electrode driver 60 and even scan electrode drover 80. By virtue of the structure above, the scan pulse voltage applying section, the falling ramp voltage generator and the voltage comparator are not necessarily required for both of odd scan electrode driver 60 and even scan electrode driver 80. This contributes to a simplified circuit structure.

Figure 6:
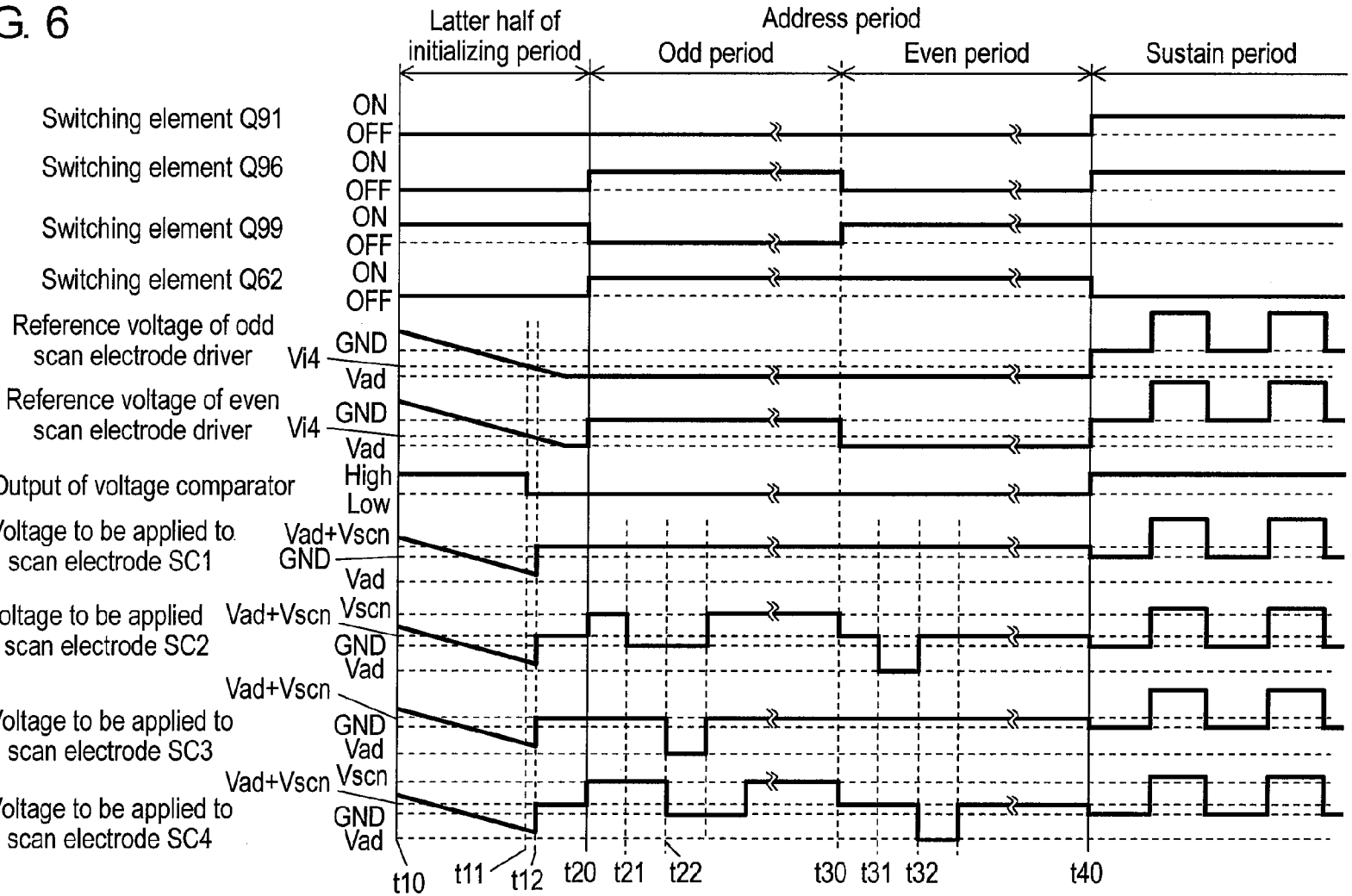
FIG. 6 shows the operations of the scan electrode driving circuit of the embodiment.

Next will be described the operations of scan electrode driving circuit 43. FIG. 6 is a timing chart from the latter half of an initializing period through a sustain period, showing the operations of scan electrode driving circuit 43 of the embodiment.

At time t10 in the latter half of an initializing period, switching elements Q91 and Q96 are turned OFF. The switching operation breaks the connection of the outputs of sustain pulse generator 51 and rising ramp voltage generator 53 from the reference voltage of odd scan electrode driver 60 and even scan electrode driver 80. Besides, switching element Q62 is turned OFF so as to break the connection between scan pulse voltage Vad and the reference voltage of odd scan electrode driver 60. Further, switching element Q99 is turned ON so as to make connection of the reference voltage between odd scan electrode driver 60 and even scan electrode driver 80.

Next, operating falling ramp voltage generator 61 allows the reference voltage of odd scan electrode driver 60 and even scan electrode driver 80 to have a gentle decrease. At this time, output sections 72 (1), 72 (3), . . . , 72 (n−1), 82 (2), 82 (4), . . . , 82 (n) turn OFF switching elements Q72 (1), Q72 (3), . . . , Q72 (n−1) for outputting voltage of the higher voltage side of power supply VSCN1 and switching elements Q82 (2), Q82 (4), . . . , Q82 (n) for outputting voltage of the higher voltage side of power supply VSCN2; and on the other hand, turn ON switching elements Q73 (1), Q73 (3), . . . , Q73 (n−1) for outputting voltage of the lower voltage side of power supply VSCN1 and switching elements Q83 (2), Q83 (4), . . . , Q83 (n) for outputting voltage of the lower voltage side of power supply VSCN2. Through the switching operation above, falling ramp voltage is applied to scan electrodes SC1-SCn.

When the reference voltage of odd scan electrode driver 60 gets lower than voltage Vi4 at time t11, the output of voltage comparator 63 is suppressed to a low level. The output signal is transmitted, via signal transmitting section 81, to output sections 82 (2), 82 (4), . . . , 82 (n) of even scan electrode driver 80, and at the same time, the signal is transmitted, via signal delaying section 71, to output sections 72 (1), 72 (3), . . . , 72 (n−1) of odd scan electrode driver 60.

At time t12, switching elements Q72 (1), Q72 (3), . . . , Q72 (n−1) for outputting voltage of the higher voltage side of power supply VSCN1 and switching elements Q82 (2), Q82 (4), . . . , Q82 (n) for outputting voltage of the higher voltage side of power supply VSCN2 are turned ON; on the other hand, switching elements Q73 (1), Q73 (3), . . . , Q73 (n−1) for outputting voltage of the lower voltage side of power supply VSCN1 and switching elements Q83 (2), Q83 (4), . . . , Q83 (n) for outputting voltage of the lower voltage side of power supply VSCN2 are turned OFF. The switching operation above increases the voltage to be applied to scan electrodes SC1-SCn.

At time t20 in the odd period of the address period, switching element Q62 is turned ON, by which the reference voltage of odd scan electrode driver 60 is fixed to scan pulse voltage Vad, and accordingly, second voltage (Vad+Vscn) is applied to scan electrodes SC1, SC3, . . . , SCn-1 located in odd rows. Besides, switching element Q99 is turned OFF and switching element Q96 is turned ON. This allows the output of sustain pulse generator 51 to be connected to the reference voltage of even scan electrode driver 80. At this time, switching element Q51 of sustain pulse generator 51 remains ON and the reference voltage of even scan electrode driver 80 takes voltage of zero (0V). That is, fourth voltage (Vs3+Vscn) is applied to scan electrodes SC2, SC4, . . . , SCn located in even rows.

At time t21, switching element Q72 (1) of output section 72 (1) is turned OFF and switching element Q73 (1) is turned ON. Through the switching operation, scan pulse voltage Vad is applied to scan electrode SC1. Switching element Q82 (2) of output section 82 (2) is turned OFF and switching element Q83 (2) is turned ON. Through the switching operation, third voltage 0(V) is applied to scan electrode SC2.

At time t22, switching element Q72 (1) of output section 72 (1) is turned ON and switching element Q73 (1) is turned OFF, switching element Q72 (3) of output section 72 (3) is turned OFF, and switching element Q73 (3) is turned ON. Through the switching operation, scan pulse voltage Vad is applied to scan electrode SC3. Switching element Q82 (4) of output section 82 (4) is turned OFF and switching element Q83 (4) is turned ON. Through the switching operation, third voltage 0(V) is applied to scan electrode SC4.

In this way, through similar switching operation, the scan pulse voltage is sequentially applied to SC1, SC3, . . . , SCn-1 located in odd rows, and at the same time, third voltage 0(V) is applied to a scan electrode adjacent to the scan electrode that is applied with scan pulse voltage Vad.

At time t30 in the even period of the address period, switching element Q96 is turned OFF and switching element Q99 is turned ON. Through the switching operation, the reference voltage of even scan electrode driver 80 is set to scan pulse voltage Vad that is equivalent to the reference voltage of odd scan electrode driver 60.

At time t31, switching element Q82 (2) of output section 82 (2) is turned OFF and switching element Q83 (2) is turned ON, by which scan pulse voltage Vad is applied to scan electrode SC2.

At time t32, switching element Q82 (2) of output section 82 (2) is turned ON and switching element Q83 (2) is turned OFF. At the same time, switching element Q82 (4) of output section 82 (4) is turned OFF and switching element Q83 (4) is turned ON. Through the switching operation above, scan pulse voltage Vad is applied to scan electrode SC4.

In this way, through similar switching operation, the scan pulse voltage is sequentially applied to scan electrodes SC2, SC4, SCn located in even rows. In the address period, the signals for controlling output sections 72 (1), 72 (3), . . . , 72 (n−1), 82 (2), 82 (4), . . . , 82 (n) are fed from timing signal generating circuit 45.

At time t40 in the sustain period, switching elements Q72 (1), Q72 (3), . . . , Q72 (n−1) for outputting voltage of the higher voltage side of power supply VSCN1 and switching elements Q82 (2), Q82 (4), . . . , Q82 (n) for outputting voltage of the higher voltage side of power supply VSCN2 are turned OFF, and at the same time, switching element Q62 is turned OFF. Further, switching elements Q91, Q96 are turned ON. Through the switching operation above, the output of sustain pulse generator 51 is connected to the reference voltage of odd scan electrode driver 60 and even scan electrode driver 80. At this time, switching element Q99 is turned ON. Besides, switching elements Q73 (1), Q73 (3), . . . , Q73 (n−1) for outputting voltage of the lower voltage side of power supply VSCN1 and switching elements Q83 (2), Q83 (4), . . . , Q83 (n) for outputting voltage of the lower voltage side of power supply VSCN2 are turned ON.

After that, the sustain pulses generated at sustain pulse generator 51 are applied to scan electrode SC1 via switching elements Q91 and Q73 (1). Similarly, scan electrodes SC3, . . . , SCn-1 located in odd rows are applied with the sustain pulses. At the same time, the sustain pulses generated at sustain pulse generator 51 are applied to scan electrode SC2 via switching elements Q96 and Q83 (2). Similarly, scan electrodes SC4, . . . , SCn located in even rows are applied with the sustain pulses.

In the plasma display device of the embodiment, as described above, the scan electrode group, which has no application of scan pulses, are applied with voltage higher than the scan pulses applied to another group, thereby suppressing decrease in wall charges. Besides, adjacent scan electrodes never undergo voltage difference beyond voltage Vscn, and therefore no worry about insulation breakdown and migration. Furthermore, the scan pulse voltage applying section, the falling ramp voltage generator and the voltage comparator are not necessarily required for both of odd scan electrode driver 60 and even scan electrode driver 80. This contributes to a simplified circuit structure.

According to the structure of the embodiment, switching element Q99, which connects the reference voltage between odd scan electrode driver 60 and even scan electrode driver 80, remains ON in the sustain period. During the sustain period, the sustain pulses generated at sustain pulse generator 51 are fed to scan electrodes SC1, SC3, . . . , SCn-1 located in odd rows via switching element Q91 and odd scan electrode driver 60; at the same time, the sustain pulses generated at sustain pulse generator 51 are fed to scan electrodes SC2, SC4, . . . , SCn located in even rows via switching element Q96 and even scan electrode driver 80. The application of sustain pulse to the scan electrodes, without turning ON switching element Q99, allows the panel to display image. However, turning ON switching element Q99 in the sustain period contributes to decreased impedance between sustain pulse generator 51 and scan electrodes SC1-SCn. Besides, it is also effective in decreasing the difference between voltage waveforms to be applied to scan electrodes SC1, SC3, . . . , SCn-1 located in odd rows and scan electrodes SC2, SC4, . . . , SCn located in even rows. This suppresses irregularity in luminance and color even when the panel shows image that imposes a considerable difference in loads between odd scan electrode driver 60 and even scan electrode driver 80, thereby enhancing image quality.

According to the structure of the embodiment, scan electrodes SC1, SC3, . . . , SCn-1 located in odd rows belong to the first scan electrode group, and accordingly, the first address period is determined to be the odd period. Similarly, scan electrodes SC2, SC4, . . . , SCn located in even rows belong to the second scan electrode group, and accordingly, the second address period is determined to be the even period. It is not limited thereto. That is, scan electrodes SC2, SC4, . . . , SCn located in even rows may belong to the first scan electrode group, and accordingly, the first address period may be determined to be the even period; and scan electrodes SC1, SC3, . . . , SCn-1 located in odd rows may belong to the second scan electrode group, and accordingly, the second address period may be determined to be the odd period. Furthermore, the grouping of the scan electrodes can be changed on a field basis.

Besides, numeric values are cited merely by way of example and without limitation; they should be properly determined according to characteristics of a panel and specifications of a plasma display device.

The present invention, as described above, provides a method for driving a plasma display device capable of suppressing decrease in wall charges and generating a stable address discharge with no worry about a spark and a short-circuit. At the same time, the method offers a simplified circuit structure with partially shared use of the scan electrode driving circuits each of which is dedicated to a divided group of the scan electrodes.

INDUSTRIAL APPLICABILITY

The present invention provides a method for driving a plasma display device capable of suppressing decrease in wall charges and generating a stable address discharge with no worry about a spark and a short-circuit. At the same time, the method offers a simplified circuit structure with partially shared use of the scan electrode driving circuits each of which is dedicated to a divided group of the scan electrodes. This is greatly useful for driving a plasma display device.

The invention claimed is:

1. A method for driving a plasma display device using a plasma display panel having a plurality of scan electrodes and a plurality of discharge cells, the plurality of scan electrodes being divided into a first scan electrode group and a second scan electrode group, and the plasma display device including:

a first scan electrode driving section for driving scan electrodes that belong to the first scan electrode group;

a second scan electrode driving section for driving scan electrodes that belong to the second scan electrode group;

a sustain pulse generating section for generating a sustain pulse to be applied to the plurality of scan electrodes;

a first switching element for adding the sustain pulse onto reference voltage of the first scan electrode driving section;

a second switching element for adding the sustain pulse onto reference voltage of the second scan electrode driving section; and a third switching element for connecting between the reference voltage of the first scan electrode driving section and the reference voltage of the second scan electrode driving section, wherein, one field period is formed by a plurality of subfields, each of the subfields having:

an initializing period for generating a initializing discharge in the discharge cells;

a first address period for generating an address discharge on the scan electrodes that belong to the first scan electrode group;

a second address period for generating an address discharge on the scan electrodes that belong to the second scan electrode group; and a sustain period for applying the sustain pulse to the plurality of scan electrodes and generating a sustain discharge in the discharge cells, the method comprising:

applying a different voltage between the reference voltage of the first scan electrode driving section and the reference voltage of the second scan electrode driving section by turning OFF the third switching element in the first address period;

applying a same voltage between the reference voltage of the first scan electrode driving section and the reference voltage of the second scan electrode driving section by turning ON the third switching element in the second address period; and in the sustain period, adding the sustain pulse onto the reference voltage of the first scan electrode driving section and the reference voltage of the second scan electrode driving section by turning ON the first switching element and the second switching element; and turning ON the third switching element.

2. The method for driving a plasma display device of claim 1, wherein the third switching element is turned ON in the initializing period.

* * * * *